US006099419A

United States Patent [19]

Incaudo et al.

[11] Patent Number: 6,099,419

[45] Date of Patent: Aug. 8, 2000

[54] INTERCHANGEABLE BALL-PRACTICE TRAINER

[76] Inventors: Peter J. Incaudo, 3838 Meridean Pl., Land O'Lakes, Fla. 34639; Howard T. Anderson, 5605 Montgomery St., Chevy Chase, Md. 20815

[21] Appl. No.: 08/262,576

[22] Filed: Jun. 20, 1994

[51] Int. Cl.[7] ..... A63B 69/22

[52] U.S. Cl. ..... 473/429; 473/430

[58] Field of Search ..... 273/26 E, 29 A, 273/58 C, 9 A; 473/423, 429, 430

[56] References Cited

U.S. PATENT DOCUMENTS

| | | | |
|---|---|---|---|
| 2,839,300 | 6/1958 | Blaha | 273/26 E |
| 3,301,556 | 1/1967 | Hamilton | 273/26 E |
| 3,540,726 | 11/1970 | Davis | 273/26 E |
| 3,893,669 | 7/1975 | Myers | 273/26 E |
| 3,994,494 | 11/1976 | Kelley | 273/26 E |
| 4,191,372 | 3/1980 | Keller | 491/372 |
| 4,462,599 | 7/1984 | Brown | 273/58 C |
| 4,576,379 | 3/1986 | Johasz | 273/58 C |
| 4,647,042 | 3/1987 | Bruce | 273/26 E |
| 4,706,964 | 11/1987 | Genovese | 273/26 E |
| 4,815,735 | 3/1989 | McClemy | 273/26 E |
| 4,881,742 | 11/1989 | Hargeave | 273/26 E |
| 5,056,781 | 10/1991 | Preston | 473/423 |
| 5,060,946 | 10/1991 | Taylor | 273/58 C |
| 5,238,251 | 8/1993 | Staka | 273/58 C |
| 5,255,911 | 10/1993 | Preston | 273/26 E |
| 5,398,940 | 3/1995 | Derst, III | 273/58 C |

*Primary Examiner*—Jeanette Chapman
*Assistant Examiner*—Stephen L. Blau
*Attorney, Agent, or Firm*—George E. Kersey, Esq.

[57] ABSTRACT

A horizontal arm is cantilevered from a lock position location so that a ball is suspended by a line from the free end of the arm. The line extends through the arm and exits at the lock position location so that the height of the ball can be adjusted by controlling an appropriate length of line. The arm is designed to allow the ball to drop free when its momentum is spent without the line becoming wrapped around the arm. The lock position location includes a position locator that extends from the arm and has a polygonal cross-section. The position locator is received by a complementary lock position receptor in the form of a recess with a polygonal cross-section that complements the cross-section of the lock projection. The attachment permits the ready dismantlement of the arm for storage or transport to another location, while simultaneously providing against inadvertent rotation of the arm during ball handling or ball hitting practice. It also permits easy adaptation to different sports—e.g., soccer to baseball—and to different vertical supports; e.g., from one basketball pole to another.

20 Claims, 12 Drawing Sheets

FIG.7A
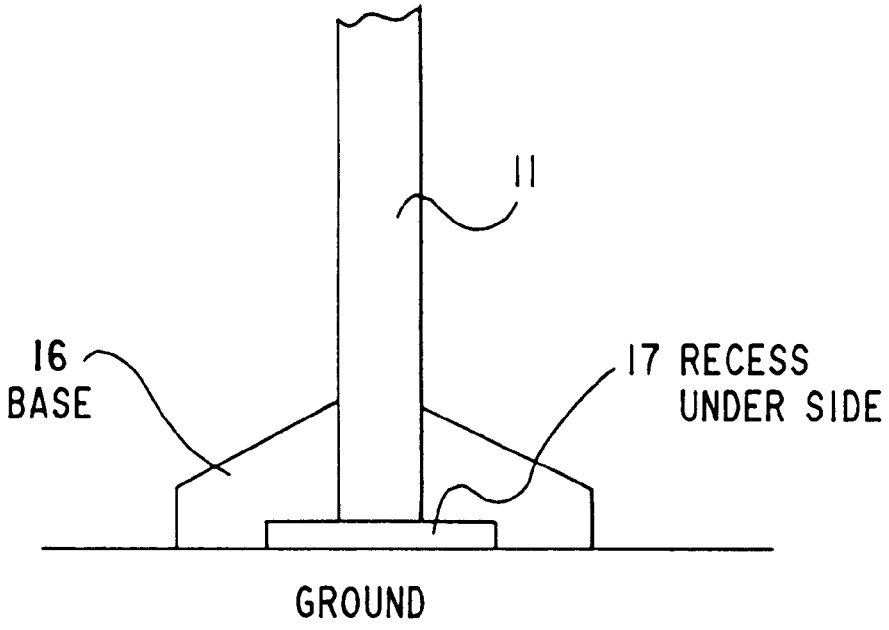
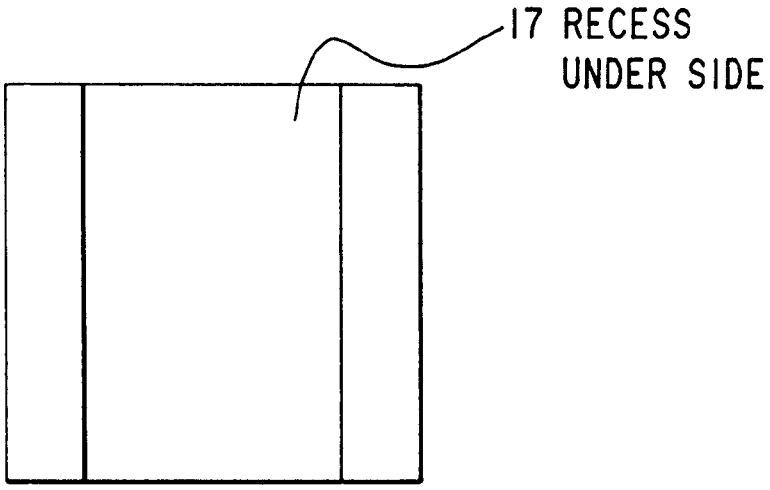
FIG.7B

INTERCHANGEABLE BALL-PRACTICE TRAINER

BACKGROUND OF THE INVENTION

1. Field of the Invention

The invention relates to training methods and devices for the practice of sporting and impacting skills, and more specifically, to the teaching and practice of ball-hitting techniques using an interchangeable device subject to a wide variety of conditions.

2. Prior Art

Many activities require proper impact with an object. It is customary to practice the impact as extensively as possible before a final, or non-practice effort is undertaken. Thus many sports require contact with a ball during play, and much effort is spent in practice to master proper timing and contact.

In tennis, for example, it is important to practice stroking and serving. In baseball, batting practice is an important aspect of training. In many other sports, such as those which require a body response or kicking, it also is important to practice contact with the ball. For example, fear of heading a soccer ball by jumping or diving is common among inexperienced or young players.

In the past, proper ball contact commonly has been taught by explanation and demonstration, followed by tossing a ball at a practicing player, who attempts to deal suitably with the ball. This method can increase a player's fear of unsatisfactory performance and reinforce improper techniques.

For many sports, training devices are known which can assist in the development of effective techniques. Examples include the "Jump Trainer" for basketball and volleyball practice, disclosed in U.S. Pat. No. 4,296,925, issued Oct. 27, 1981; the "Tether Ball Apparatus" of U.S. Pat. No. 4,158,458, Jun. 19, 1979; the "Tethered Ball Tennis Instruction Device" of U.S. Pat. No. 3,893,669, Jul. 8, 1975; the "Batting Practice Apparatus" of U.S. Pat. No. 3,540,726, Nov. 17, 1970; the "Supporting Structure and Ball Releasably Suspended Therefrom" of U.S. Pat. No. 3,397,885, Aug. 20, 1968; the "Miniaturized Table Tennis Game with Captive Ball" of U.S. Pat. No. 3,477,717, Nov. 11, 1969; the Foldable Captive Ball Game Apparatus" of U.S. Pat. No. 3,262,703, Jul. 26, 1966; the "Batting Practice and Training Device" of U.S. Pat. No. 3,166,317, Jan. 19, 1965; the "Ball Holder" for baseball practice of Anson U.S. Pat. No. 2,772, 882, Dec. 4, 1956; and the "Game Apparatus" of U.S. Pat. No. 1,441,221, Jan. 9, 1923.

The foregoing training devices suffer from inadequate portability, restriction to use with special and often complex frames, undue complexity and accompanying high cost.

Other sports training devices suffer from similar difficulties. Thus Keller U.S. Pat. No. 4,191,372 issued Mar. 4, 1980 for "Tennis Trainer Device", pictured in FIG. 9A, discloses an angular support arm for a practice tennis ball attached to a vertical post by a member of circular cross-section. This is needed for the kind of telescopic adjustments prescribed by Keller. Similrly, Hargreave U.S. Pat. No. 4,881,742 issued Nov. 21, 1989 for "Volleyball Technique Trainer" pictured in FIG. 9B also makes telescopic adjustments. Likewise, Taylor U.S. Pat. No. 5,060,946 issued Oct. 29, 1991 for "Volleyball Practice Device" pictured in FIG. 9C makes telescopic adjustment using a sprocket and teeth engagement. In addition the end of a polygonal arm in Taylor is blocked by a shaft that is carried by a bearing.

Another telescopic adjustment is shown in Radley British Patent Specification 305,265 accepted Feb. 4, 1929 for "Improvements in Appliances for Golf Practice".

The telescopic adjustments of Keller, Hargreave, Taylor and Radley are undesirable because they add to complexity and reduced stability.

In addition, Keller, Hargreave and Taylor teach portability which would be completly defeated if stabilization were attempted, for example, in the fashion of French Patent 1,317,990 delivered Jan. 7, 1963 for "Jeu d'Adresse" pictured in FIG. 9D. The French patent discloses a fixed extension of a mast for encasement in the ground, and, therefore, is not easily portable.

Accordingly, it is an object of the invention to avoid the need for telescopic adjustments. Another object is to achieve simultaneous portability and ground stability.

Hargreave and Taylor must use telescopic adjustments because their balls are fixed in relation to their ball-support arms. Keller likewise must use a telescopic adjustment because of a height adjustment limitation set by the weight that he employs.

Accordingly, another object of the invention is to overcome the need for fixed positioning of practice balls in relation to ball-support arms.

Moreover, Keller, Hargreave and Taylor need to use fasteners, or their equivalents, to stabilize their standards. Thus Keller and Hargreave use drilled cross-sections with bolts, nuts or keys to secure arms to vertical posts, and Taylor requires welding.

It is desirable to permit total freedom of adjustment by having components that are not fixed by bolts, nuts, keys or the like. Thus the arms in Keller and Hargreave do not permit such adjustment because their arms require adjustment by a drilled cross-section and a key position lock. Similarly, the generally horizontal ball-supporting arm in Taylor is connected to a vertical pole by welding.

Accordingly, any attachment of arms to a generally vertical post following the teachings of Keller, Hargreave or Taylor would be accompanied by the need for a telescopic adjustment. Radley is similarly objectionable in teaching an arm with a hooked end that is used in supporting cords that, in turn, support a drilled ball. The arm in Radley has an end section that slopes downwardly in the fashion of Keller, supporting the drilled ball, and like Hargreave, needs to use a fastener or equivalent to stabilize a standard. The end of the arm in Radley also has a set of indentations which would could cause entanglement with the cord if the practice ball received a sufficient impact.

Accordingly, a principal object of the invention is to provide a device for use in training players in effective and safe ball-hitting techniques.

It is also an object of the invention that such device be of simple and inexpensive construction.

Another object is to provide a device in light-weight form that can be disassembled quickly and easily for transport to a training site, such as in the trunk of an automobile.

Still another object is to provide a device that can easily and quickly be adapted for different kinds of ball-hitting (e.g., baseball or tennis) and different mounting options (e.g., pole-mounted or wall-mounted).

A further object is to provide device which, in use, will overcome the disadvantages and shortcomings of the prior art.

Still another object of the invention is to permit total freedom of adjustment of a ball up to the free end. A related object is avoid the need for telescopic vertical pole adjustment.

By contrast, the invention permits total freedom of adjustment. An arm is received, but is not fixed by bolts, nuts, keys or the like.

SUMMARY OF THE INVENTION

In accomplishing the foregoing and related objects, the invention provides a training device for suspending a ball by a line from one end of a substantially horizontal boom or arm, with a lock position locator or connector at the opposite end of the arm to provide interchangeability under a wide variety of circumstances.

Thus, the connector allows the arm to be interchangeably cantilevered from a mounting device that is secured to a grounded or base positioned upright standard, a wall or roof surface, or a pole that is in use for other purposes.

In a preferred embodiment of the invention, the connector is a protuberance of polygonal cross section that extends at a substantially right angle with respect to the principal axis of the horizontal boom. The arm from which the ball is suspended can have a bend in its horizontal section, and the line suspending the ball can pass over a pulley carried inside the horizontal arm, then through the arm and exit from the arm over a further pulley in the vicinity of the connector. The height of the ball can be adjusted by hauling in or paying out the line, and the line can be anchored to a cleat or other suitable fastener.

When the ball is struck, the bend in the horizontal boom allows the line to fall free from the boom when the ball's momentum is spent, preventing the line from wrapping itself around the boom. Experimentation with different angles showed that the angle indicated in the attached figures achieved unexpectedly good results in this regard. When a lesser angle was used, the cord tended to wrap around the boom; a greater angle required the boom to be positioned too high.

In accordance with one aspect of the invention the arm or boom has its lock connector received by a lock position locator which can be integrated into a ground or base mounted standard, a wall surface, or be attachable to a preexisting pole or other cylindrical member.

In accordance with a further aspect of the invention the lock position locator has a polygonal aperture that mates with the polygonal cross section of the connector. In a preferred embodiment of the invention the polygonal aperture is rectangular or square.

In accordance with still another aspect of the invention a practice device is formed by an elongated arm that can be cantilevered from a support to project in a generally horizontal direction. A line having one end connectable to an object is guided generally along the length of the arm to suspend the object from an outer free end of the arm at a height appropriate for practicing with the object. A projection having a polygonal cross section is carried by the arm for securing the arm to the support. The free end portion of the line is attached to the support to maintain the object at an appropriate height and enable adjustment.

The support can be an elongated standard formed from a plurality of elongated tubular sections connectable generally in end-to-end alignment in a non-rotative relationship. A portable base can receive one end of the standard for supporting the standard in an upright position. The base can include a ground connector for deterring rotation of the standard relative to the base.

The elongated arm can be tubular and be cantilevered from the upper portion of a standard so as to project generally horizontally when the standard is in an upright position. The arm can have a roller at the generally free end portion and carried inside the bore of the arm. A line can have one end connected to an object in the form of a ball and be threaded over the roller. A guide carried by the arm can be included for guiding the line generally along the arm, and a cleat carried by the standard can enable the free end of the line to be anchored to the cleat for maintaining the ball at a desired height selected for an individual player and appropriate for the player to practice with the ball.

Through experimentation it was determined that no roller, guide, pulley or similar apparatus was desirable for guiding the line through or along the arm. Unexpectedly good results were obtained by using a squared or rounded surface at the end of the arm from which the ball is suspended, and by incorporating a bend in the arm in the range of 0° to 18° from the horizontal, which angle allows the ball to drop free after its momentum is spent.

The securing projection of polygonal cross-section is received by a recess of complimentary cross-section in the support. The securing projection desirably has a square cross-section and complements a square cross-section in the support. The support can be elongated vertical member which is secured in the ground.

In accordance with a still further aspect of the invention, the elongated arm can have two linear sections disposed at an obtuse angle greater than 145° relative to one another. The end of the arm is secured to the support below the end position of the arm where the line is connected to the object. The elongated arm can have two linear sections joined by a curved elbow, with one linear section joined to the support having a length less than that of the other linear section.

In a mounting device for attaching an elongated arm for use in ball handling or hitting practice, a base includes a lock position locator for receiving the elongated arm in a non-rotating relationship, and a clamp secures the base to a support. The clamp can be "U" shaped with a connector to the base with the support between the clamp and the base. The lock position locator can be externally attached to the base, be integrally included within the base. The "U" shaped clamp has either a flattened or a rounded end to conform to an associated surface of a support to which the mounting device is attached.

In a method of practicing the handling or the impacting of an object, the steps include providing an elongated arm that can project from a support in a generally horizontal direction, mounting the elongated arm on the support by a position locator that projects from one end of the arm and is lockingly engaged by the support, and attaching the object to the free end of the arm at an appropriate height for the practice or hitting exercise that is to be undertaken.

The projecting position locator is polygonal in cross-section and is lockingly engaged in the support in a complementary polygonal recess. The object is attached to the arm by a line that extends into the free end of the arm and exits at the position of the projecting position locator. The mounting of the elongated arm can be on a separate mounting device which is removably secured to the support. The separate mounting device can include a lock position locator which forms a sleeve for receiving the projecting position locator and has a length that exceeds the maximum cross-sectional dimension of the lock position locator. Adjustment of the position of the object with respect to the end of the arm is made by appropriately positioning a portion of the line exiting from the arm with respect to the support.

DESCRIPTION OF THE DRAWINGS

Other aspects of the invention will become apparent after considering several illustrative embodiments of the invention, taken in conjunction with the drawings in which:

FIG. 7A is a partial elevation of a mounting standard with a recessed underside in accordance with the invention.

FIG. 7B is a bottom view of the mounting standard of FIG. 7A with a recessed underside in accordance with the invention.

DETAILED DESCRIPTION

Figure 1:
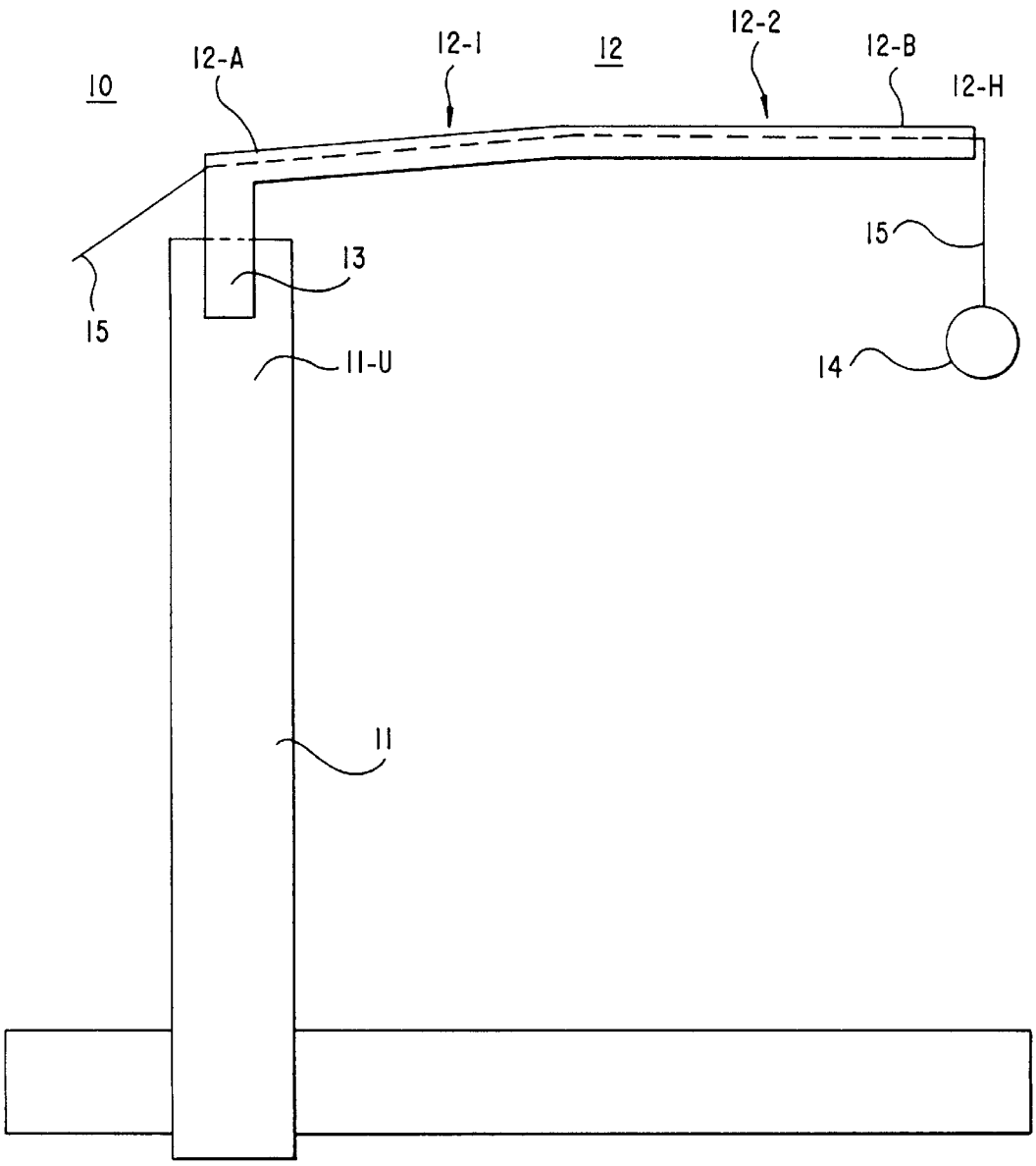
FIG. 1 is a side elevation of a practice device in accordance with the invention.

With reference to the drawings, FIG. 1 shows a practice device 10 in accordance with the invention which includes a vertical standard 11 that can be of metal or of strong molded plastic material. The standard 11 of FIG. 1 is securely anchored in the ground, with its upper end portion 11-*u* of including a receptor 13 into which the end portion 12-*a* of a tubular arm 12 is fitted to maintain the arm 12 in a generally horizontal, upright position. A special, complementary design of the end 12-*a* and the receptor 13 prevent undesired rotation of the arm 12 relative to the standard 11.

Figure 4A:
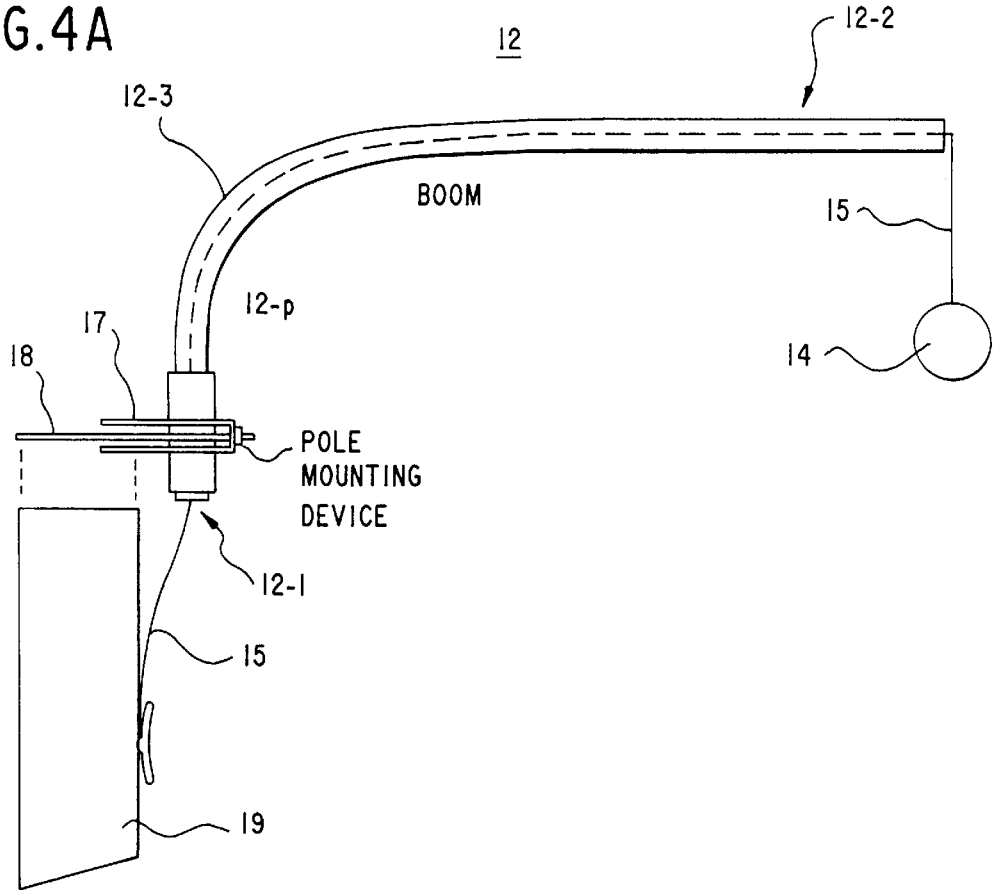
FIG. 4A is a fragmentary view of a pole mounting of a device in accord with the invention.
Figure 4B:
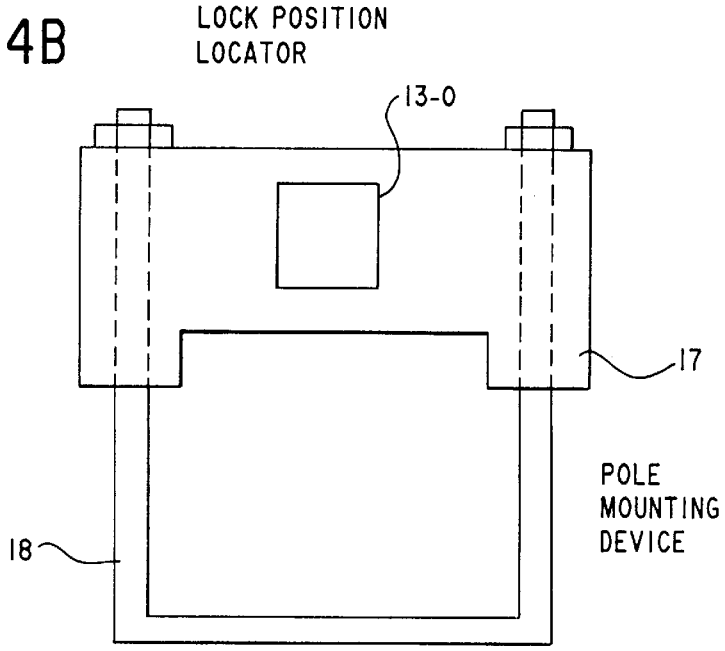
FIG. 4B is a plan view of the pole mounting device used in the embodiment of FIG. 4A.
Figure 5A:
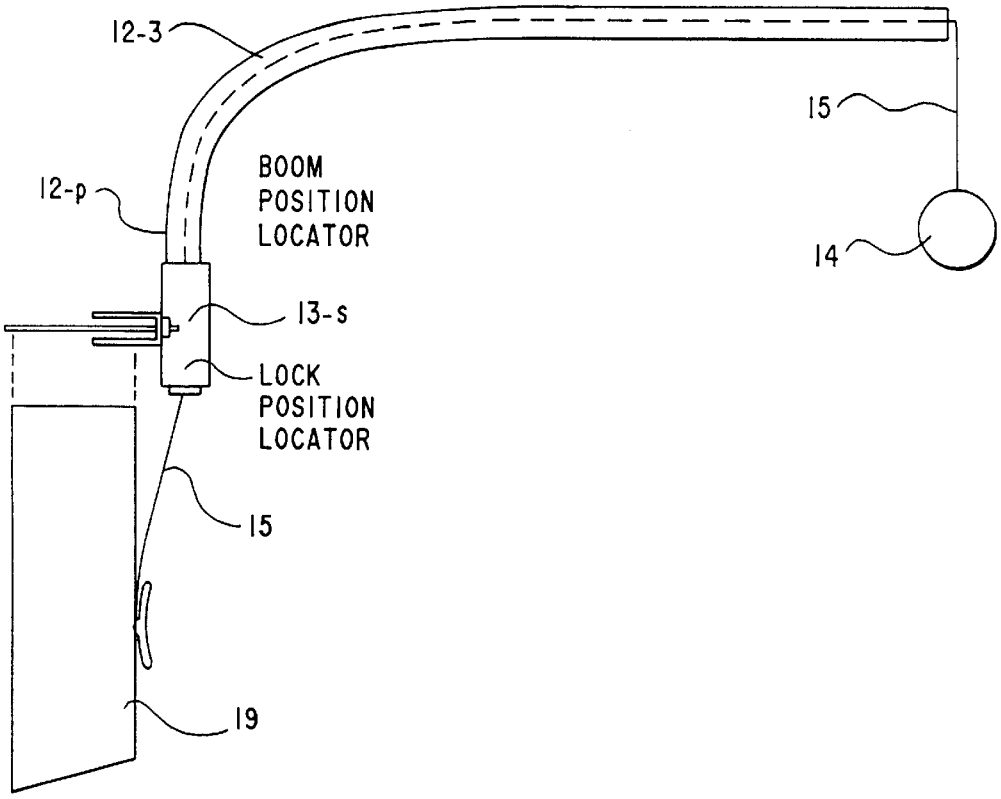
FIG. 5A is an alternative fragmentary view of a pole mounting of a device in accordance with the invention.
Figure 5B:
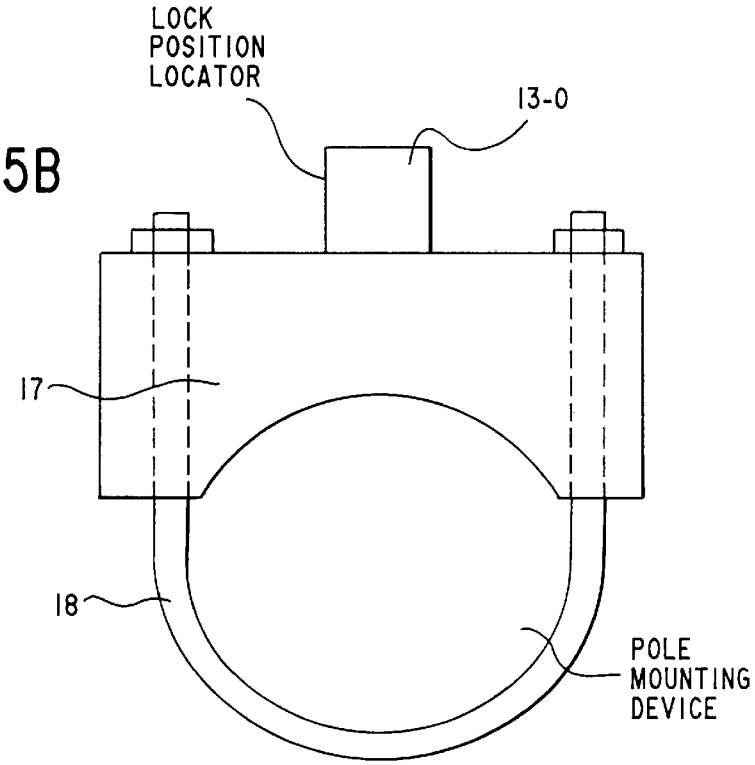
FIG. 5B is a plan view of the pole mounting device used in the embodiment of FIG. 5A.

The upper end portion 11-*u* of the standard 11 snugly receives the end portion 12-*a* of the arm 12. The specific form of opening 13-*o* used for the receptor 13 is best seen in FIGS. 4B and 5B.

Figure 2:
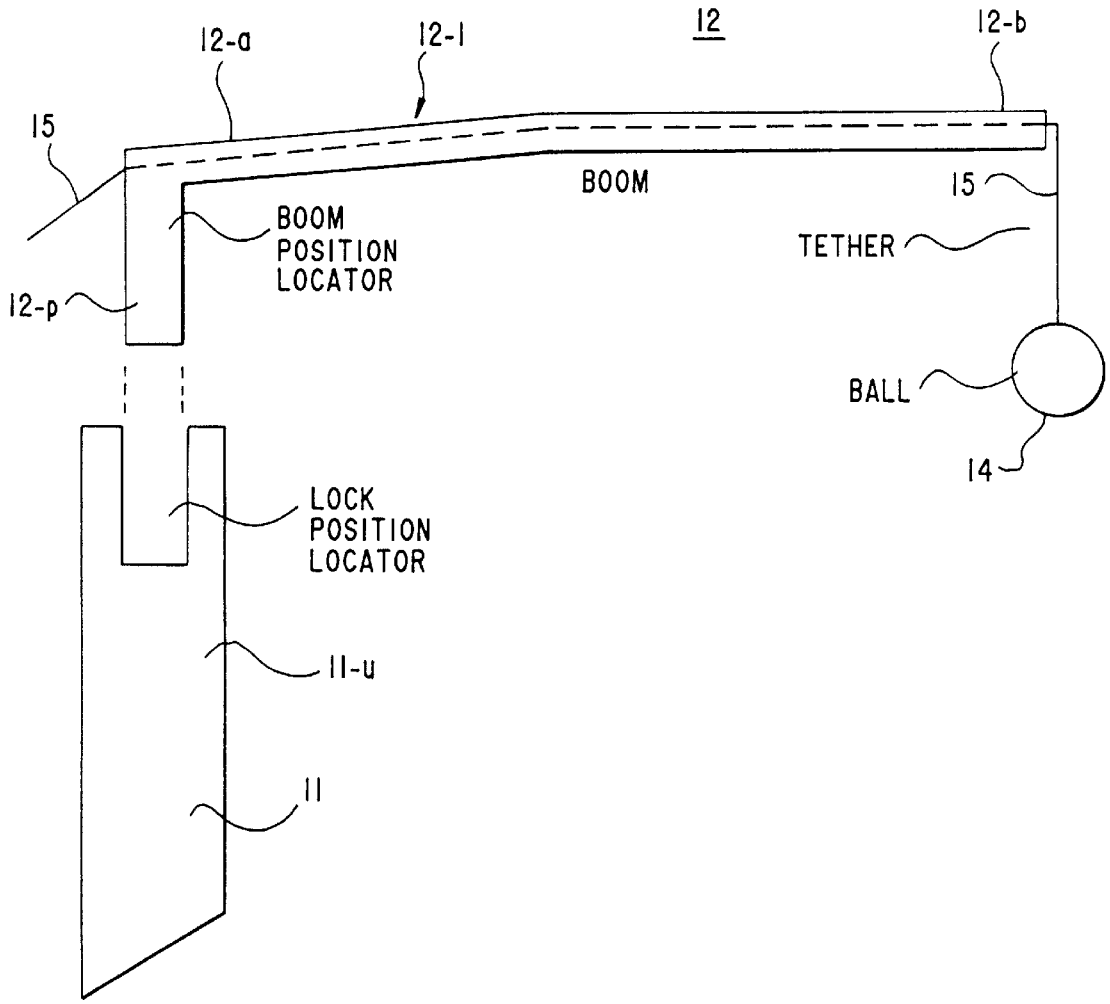
FIG. 2 is a partial top view of the device of FIG. 1.

To prevent relative rotation of the standard 11 and the arm 12, when in an upright position, the end 12-*a* is a projection 12-*p* that extends into the upper end 11-*u* of the standard 11 along the phantom (dashed-line) representation as shown in FIG. 2. As a result the projection 12-*p* becomes secured to a position locator aperture 13-*o* in contact with the upright sides of the aperture. Preferably, the projection 12-*p* is flush with the sides of the aperture 13-*o* and engages the walls of the aperture 13-*o* in a way that the projection 12-*p* of the arm does not become wedged in the receptor 13. This prevents making the separation of the two parts 11 and 12 difficult when it is desired to demount the arm 12 from the standard 11.

Preferably, the standard 11 is of light-weight metal tubing such as aluminum alloy, but it can be of any suitable material.

A ball 14 is suspended from the outer end 12-*b* of the horizontal arm 12 by a flexible line 15 which can be a rope or a cable. From the ball 14 the line 15 extends through the end opening 12-*a* of the arm 12 around a pulley or roller 12-*p* carried by a horizontal axle 12-*h*. From the roller 12-*p* the cord 15 extends within the arm 12 and out through an opening 12-*a*.

In FIGS. 1 and 2, the arm 12 has a straight end section 12-1 for which a further roller (not shown) can be included. Alternatively the arm 12 can have a 90 degree bend 12-3 as shown in FIGS. 4A and 5B. The free end portion of the line 15 is anchored to an attachment, such as a cleat, on the lower end portion of the standard 11.

In use, the height of the ball 14 can be adjusted for an individual player by loosening the line from the cleat, hauling in or paying out the appropriate length of line and again anchoring the line to the cleat.

In the case of soccer, for example, with an inexperienced player, the ball would be positioned at about eye level and, since the ball will be stationary, the player can be instructed as to proper techniques. He can then practice such techniques without fear of the ball striking the player's face, for example. As the player gains more confidence, the ball can be swung up to be acted upon by the player when the ball swings back down. For more experienced players, the ball can be positioned higher for practicing jumping, or lower for practicing diving.

The demountable construction of the assemblage 10 allows the arm 12 and the standard 11 to be assembled and disassembled quickly and allow the arm 12 to be transported easily such as in the trunk of an automobile. Preferably, the height of the standard 11 is at least about 11 feet (3.3 meters), so that the ball 15 always is suspended a substantial distance below the horizontal arm 12.

Figure 3:
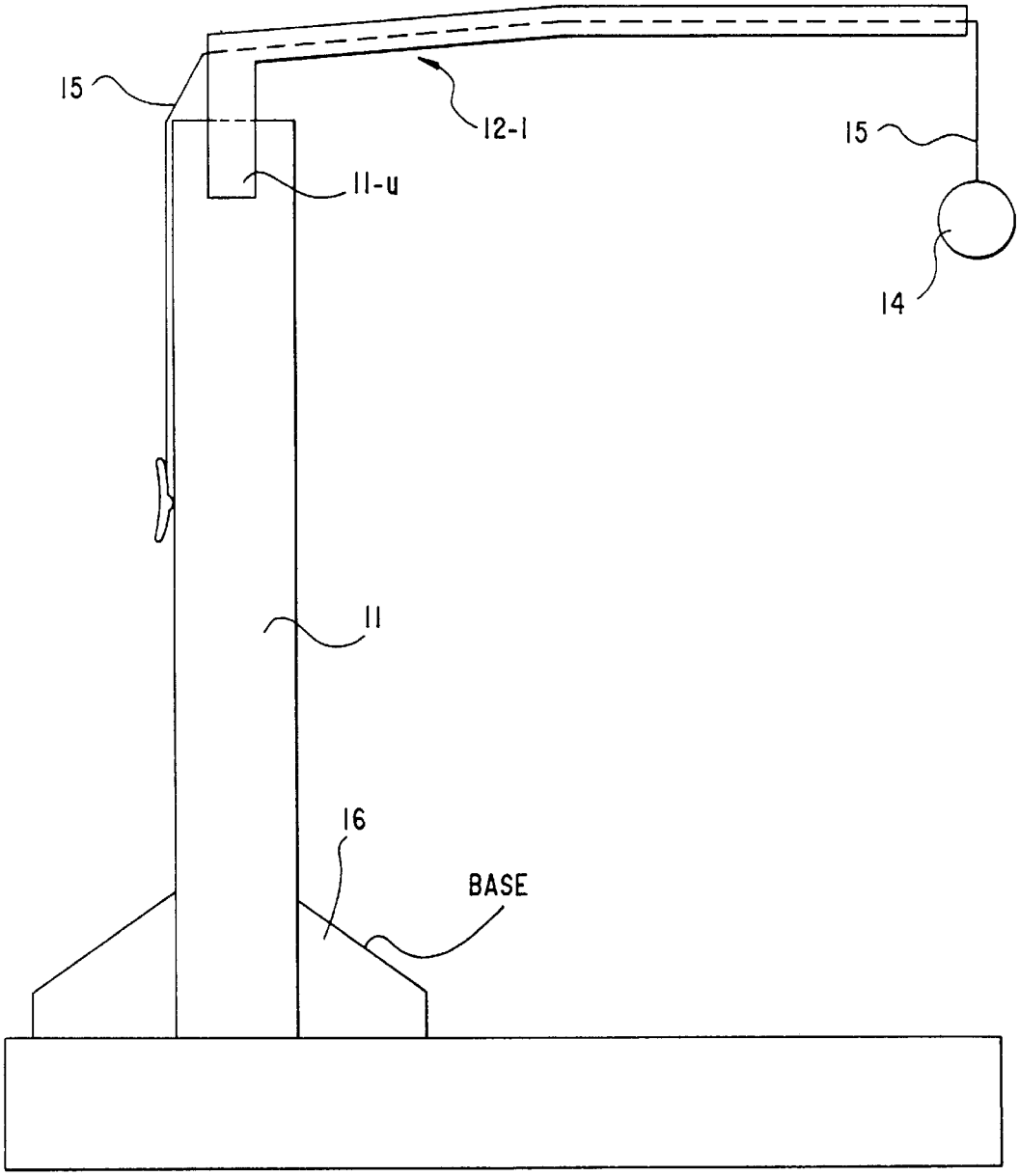
FIG. 3 is an alternative view of a practice device in accordance with the invention.

In the alternative embodiment of FIG. 3, the standard 11 is portable and include a demountable base 16, which can be about 2 to 3 feet (0.6 to 0.9 meter) in diameter and filled with sand to weigh about 60 to 80 pounds (27.22 to 36.29 kilograms). The base 16 supports a tubular standard 11 of a diameter of about 2 inches (50.8 millimeters) in stable fashion. The horizontal arm 12 should be at least about 3 feet (0.9 meter) long so that a player will not contact the standard while practicing.

In the embodiments of FIGS. 4A and 4B, the arm 12 includes an elbow 12-2 between end sections 12-1 and 12-3. The end 12-3 can extend to a projection 12-*p* of the kind shown in FIGS. 1 through 3, or the end 12-3 itself can form the desired projection for engaging the opening 13-*o* of FIGS. 4B and 5B.

In both cases the opening 13-*o* is associated with a base 17 of FIG. 4B or 17' of FIG. 5B. The base 17 or 17' is used with a clamp 18 or 18' for connection to an appropriate vertical support, such as a pre-existing pole 19.

In FIG. 4B the pole 19 has a rectangular cross section, and the base 17 surrounds the opening 13-*o*. In FIG. 5B the pole 19' has a circular cross section, and the opening 13-*o* is attached to the base 17'. Further, the opening 13-*o* of FIG. 5B is in an elongated sleeve 13-*s* as shown in FIG. 5A.

Figure 6:
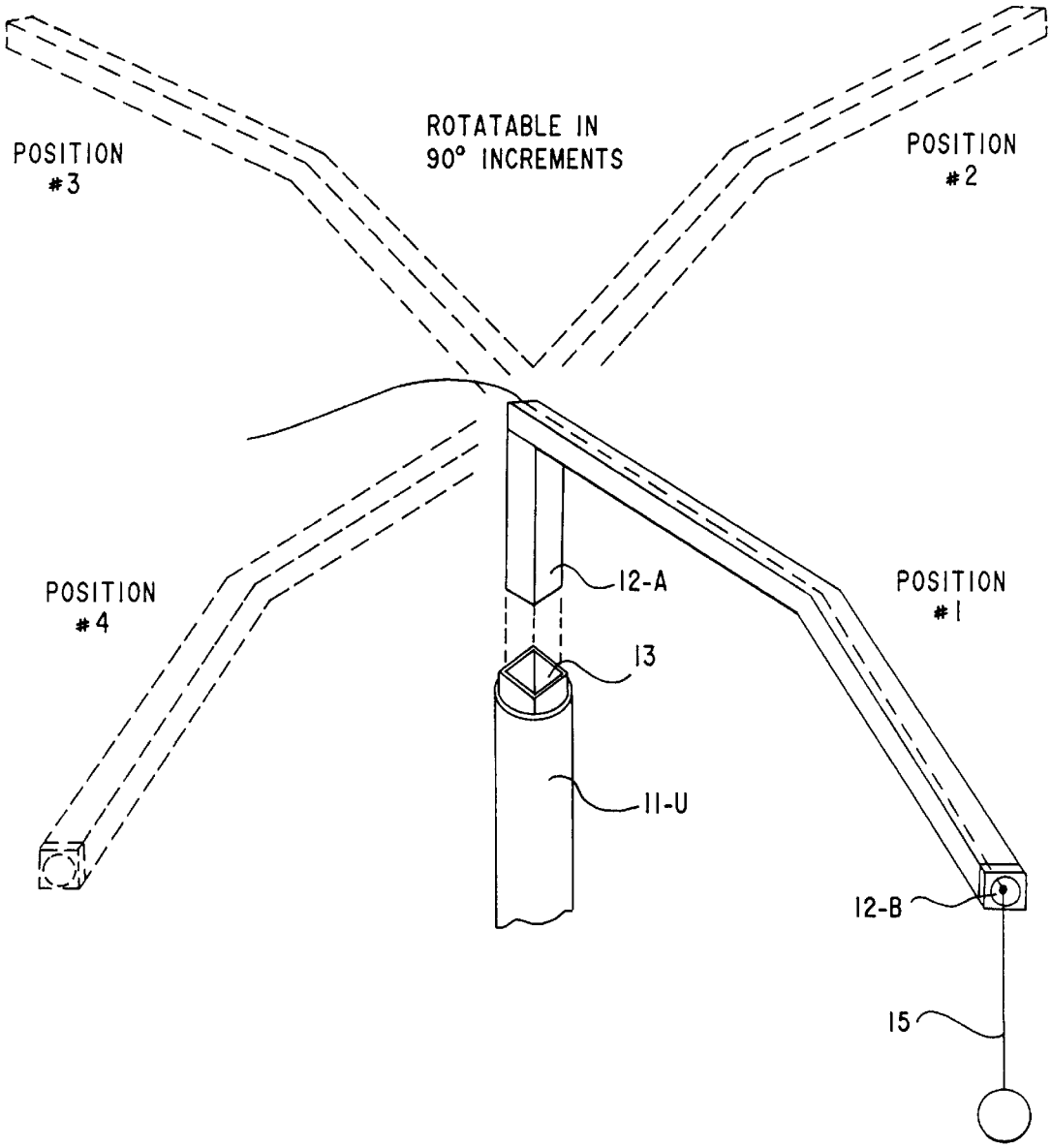
FIG. 6 is a partial perspective view showing various rotational positions for a tubular arm in relation to an associated mounting standard.

FIG. 6 is a partial perspective view showing various rotational positions for the tubular arm 12 of FIG. 1 in relation to an associated mounting standard 11-U. The upper end portion 12-A of the the arm 12 is received by a receptior 13 positioned within the cylindrical housing of the mounting standard 11-U. The end opening 12-B of the arm 12 is a circular fitting through which the the line 15 extends to the ball 14. When it is desired to move the position of the arm 12, the end portion 12-A is lifted outb of the receptor 13 and moved in 90° increments. A first movement of 90° moves the arm 12 from position #1 to position #2. A further movement of 90° moves the arm 12 to position #3, and a still further movement of 90° moves the arm 12 to position #4.

In FIG. 7A, which is a partial elevation of a demountable base 16 for a mounting standard 11, the base 16 has a recessed underside 17 in accordance with the invention, as shown in FIG. 7B. The recess 17 permits the base 16 to be accommodated by an irregular ground surface, and for that purpose the feet 16-F of the base 16 are in the form of relatively narrow strips.

Figure 7C:
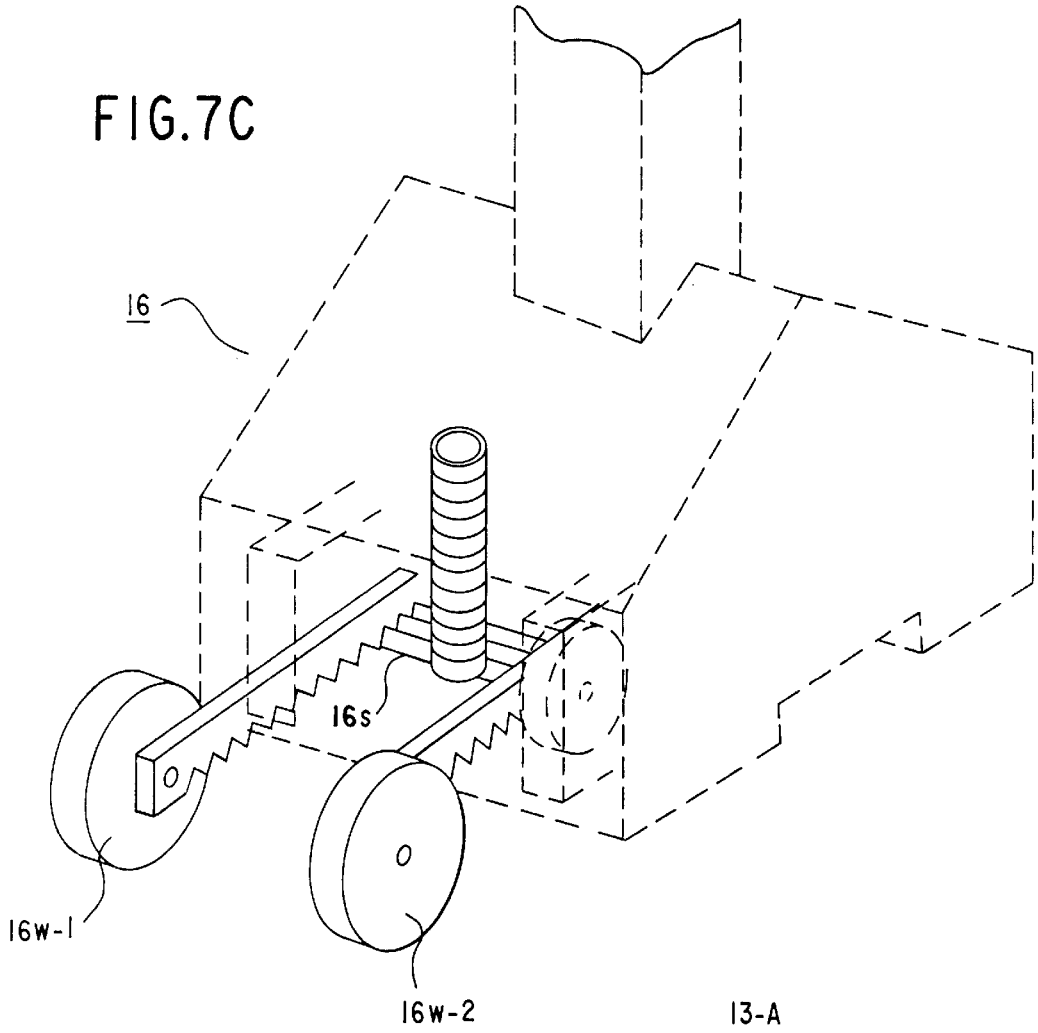
FIG. 7C is an adaptation of the mounting standard of FIG. 7A to facilitate movement of the standard in accordance with the invention.

In the adaptation of FIG. 7C, the base 16 has extensible wheels 16*w*-1 and 16*w*-2 which can be withdrawn into the base 16 by using an external key (not shown) to rotate the internal screw 16*s*.

Figure 8:
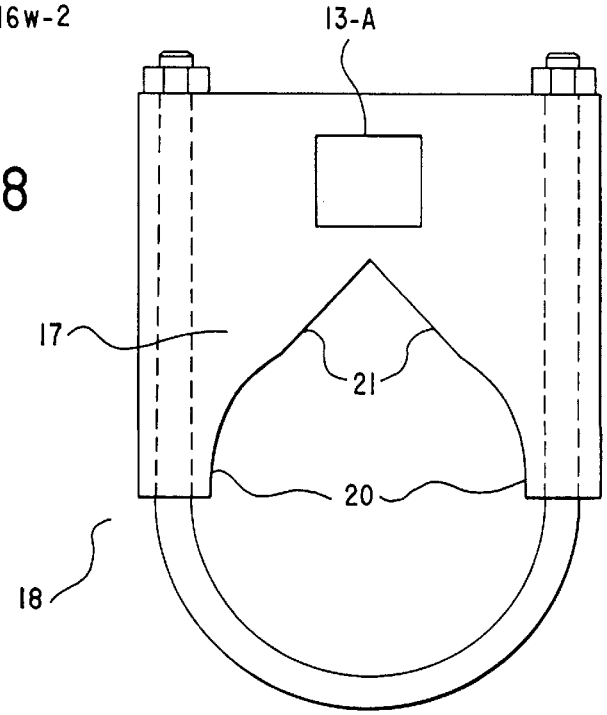
FIG. 8 is a plan view of a pole mounting device in accordance with the invention.
Figure 9A:
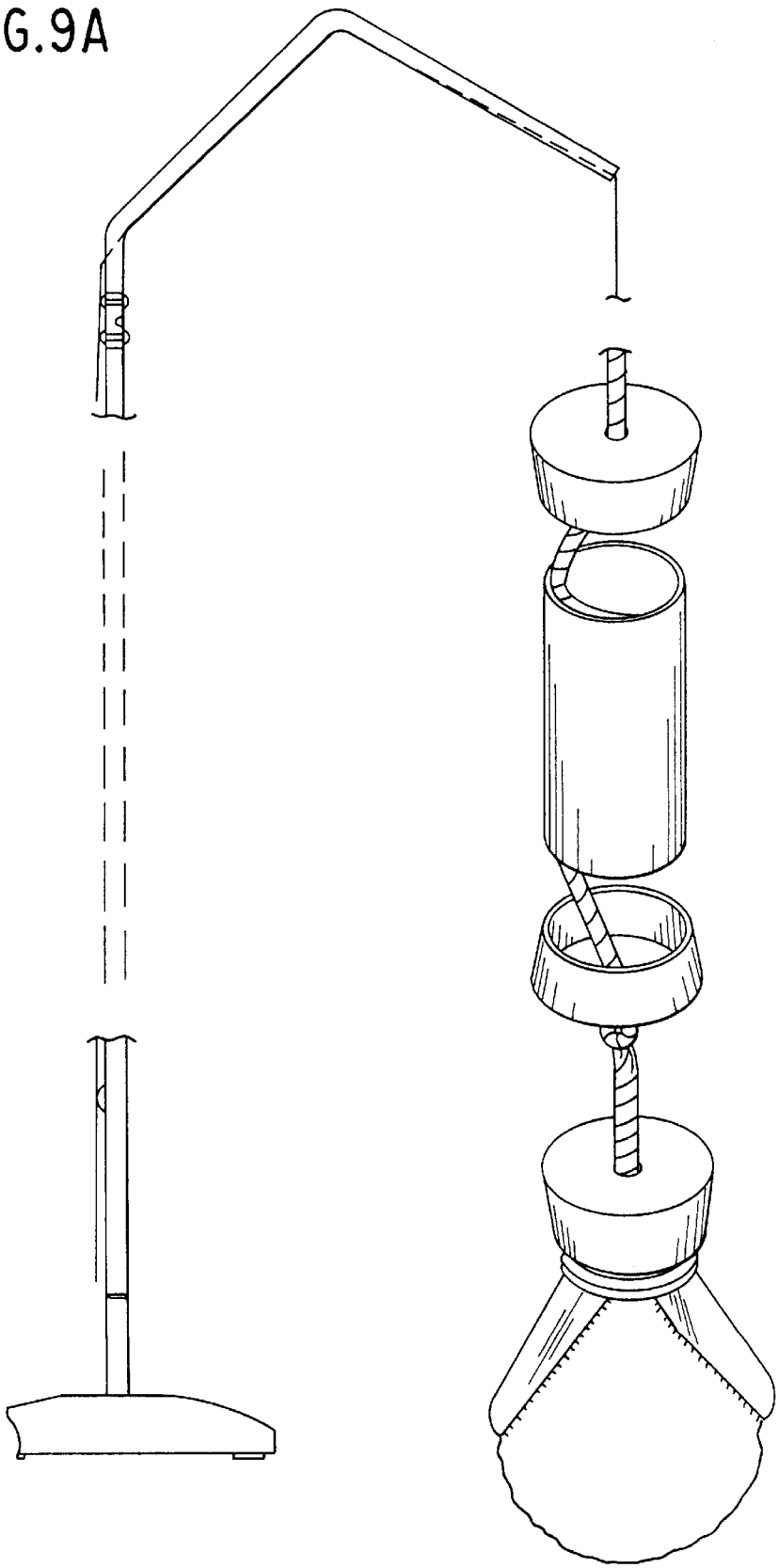
FIG. 9A is a view of the prior art of Keller U.S. Pat. No. 4,191,372.
Figure 9B:
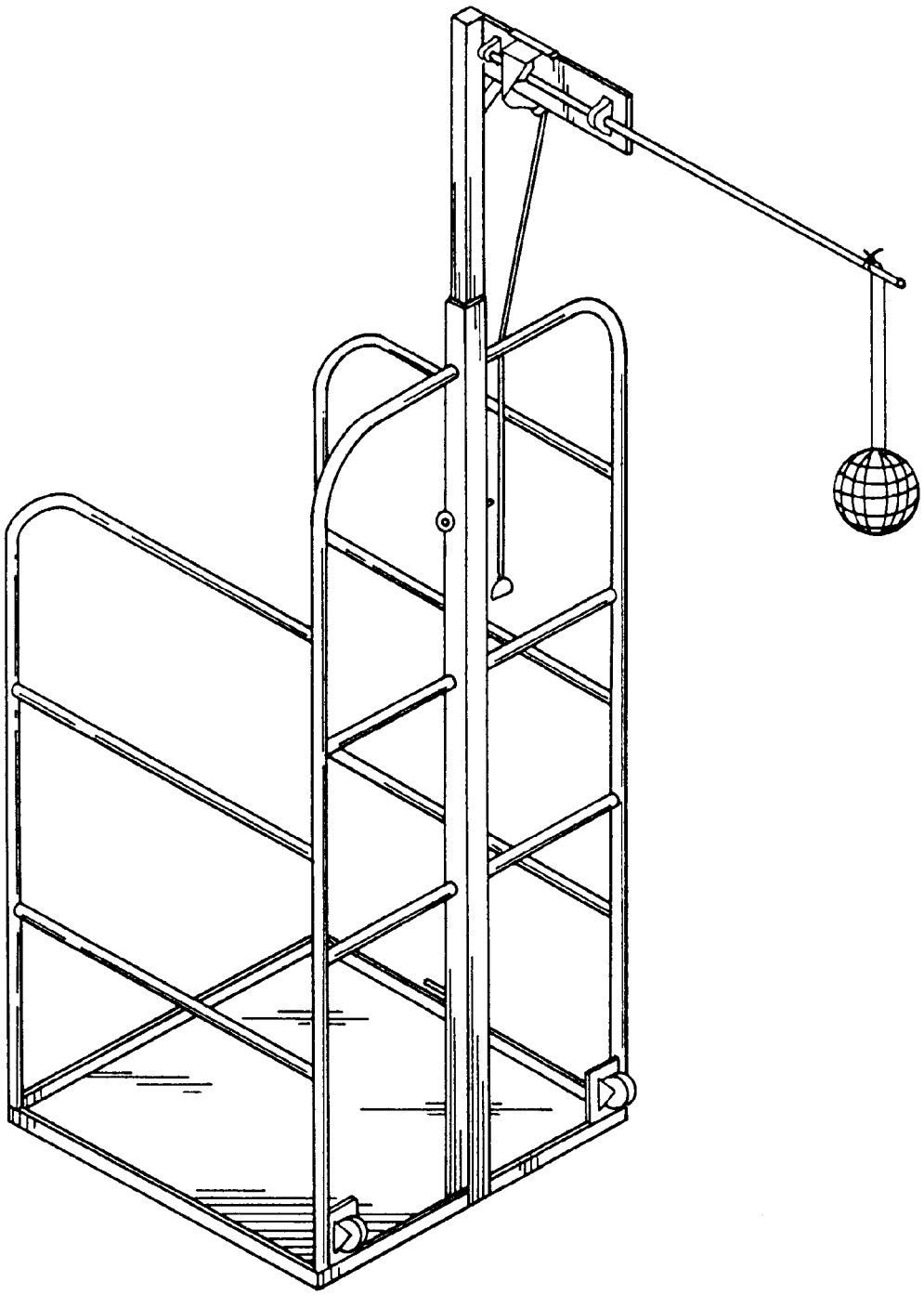
FIG. 9B is a view of the prior art of Hargreave U.S. Pat. No. 4,881,742.
Figure 9D:
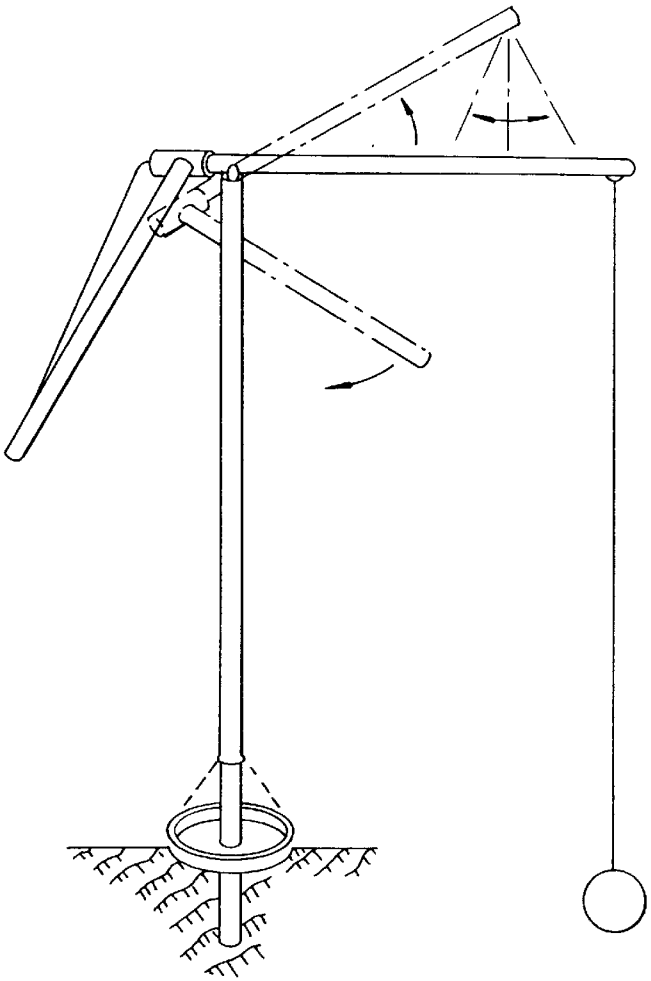
FIG. 9D is a view of the prior art of French patent 1,317,990.
Figure 9C:
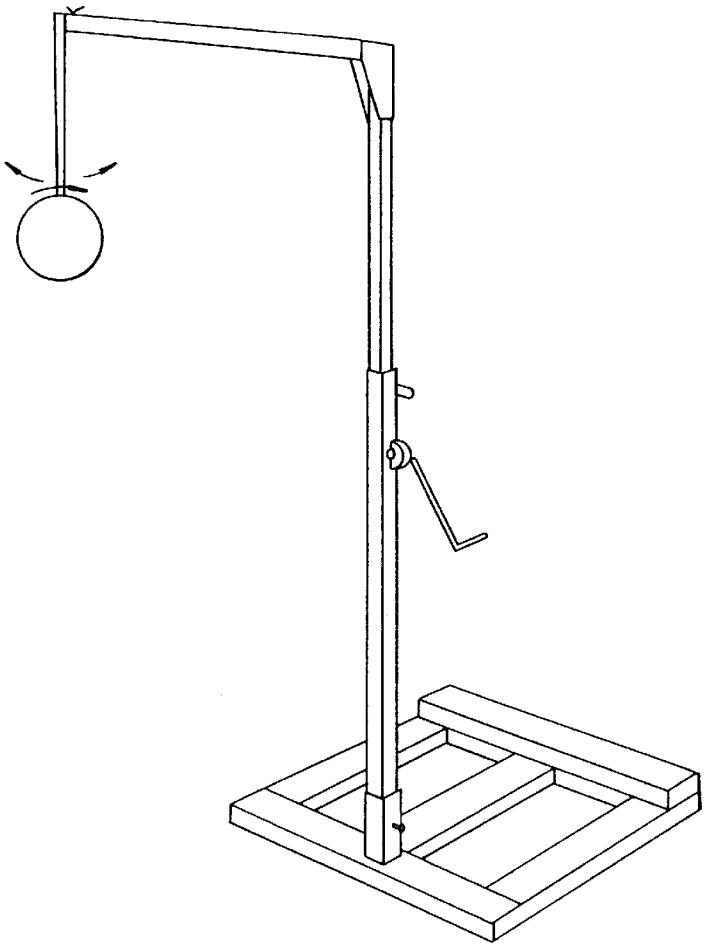
FIG. 9C is a view of the prior art of Taylor U.S. Pat. No. 5,060,946.
Figure 9E:
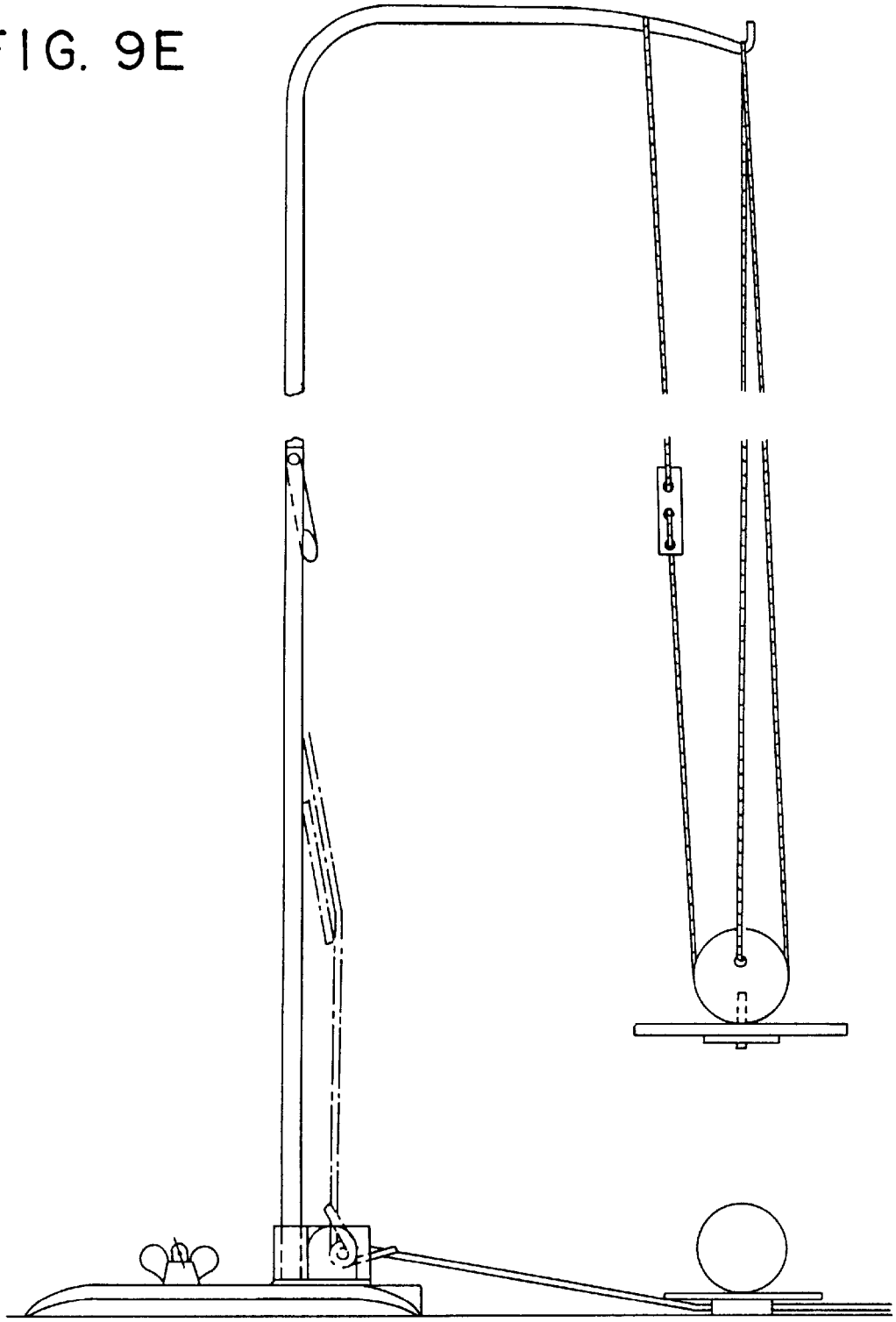
FIG. 9E is a view of the prior art of Radley British patent 305,265.

In the alternative pole mounting device 18 of FIG. 8, in plan view, the web 17 includes the lock position locator 13-A and a right-angular cutaway portion 21 so that the mounting device can accommodate a wide variety of mounts.

It will be understood that the foregoing embodiments are for illustration only and that other modification and adaptations of the invention may be made by those of ordinary skill in the art without departing from the spirit and scope of the invention.

What is claimed is:

1. The method of practicing the handling and impacting of an object which comprises the steps of a. providing an elongated arm that is substantially straight except for a curvature between an engagement end and a free end and a bend at said engagement end which has a position locator with a polygonal cross section, and said elongated arm is provided with a tubular bore having a polygonal cross section at its free end;

b. inserting said position locator into a support so that said elongated arm extends horizontally from said support, with said support having a recess with a shape complimentary to said polygonal cross section of said position locator, thereby to hold said locator in said support without need for fasteners; and c. attaching an object at said free end of said elongated arm at an appropriate height for the practice of impacting that is to be undertaken.

2. The method of claim 1 wherein said recess of said support has sides and walls further including the step of having said position locator flush with the sides of said recess and engaging the walls thereof so that said position locator does not become wedged; thereby to prevent making the separation of the two parts difficult when it is desired to demount said position locator from said support.

3. The method of claim 1 wherein said object is attached at said arm by a line that extends into said free end of said arm and exits therefrom at the position of said position locator.

4. The method of claim 1 wherein said elongated arm is provided by two linear sections disposed at an obtuse angle greater than 145° relative to one another; and the end of said arm is secured to said support below the end position of said arm where said line is connected to said object.

5. The method of claim 1 wherein said elongated arm is provided by two linear sections joined together, with one linear section joined to said position locator having a length less than that of the other linear section.

6. The method as defined in claim 1 wherein said object is a ball.

7. The method of allowing the practice of impacting an object using an arm that can be circumferentially repositionably cantilevered from a mounting device secured to a base-positioned upright standard, including a pole in use for other purposes, which comprises the steps of:

a. providing said arm as an elongated member with a bend between opposed ends thereof and a polygonal cross-section at one of said ends;

b. cantilevering said arm from said mounting device to project in a generally horizontal direction;

c. providing a line having two ends, one of which is free and unconnected, and the other of which is connected to an object;

d. guiding said line generally along a length of said arm over said bend to suspend said object directly from said free end of said arm at a height appropriate for practicing with said object;

e. repositionably securing said arm at a fixed height of said mounting device by means having a polygonal cross-section; and f. attaching the free end portion of said line to maintain said object at said appropriate height and enable adjustment thereof.

8. The method of claim 7 wherein said elongated arm is provided with a tubular bore having a polygonal cross section and an open, rounded surface at its free end, further including threading said line through the bore of said arm and connecting to a ball, and securing the free end of said line relative to said standard for maintaining said ball at a desired height selected for an individual player and appropriate for such player to practice with said ball.

9. The method of claim 7 wherein a recess of complementary cross-section in said mounting device is provided for receiving the securing means having a square cross-section and securing said mounting device; and securing said support as an elongated vertical member in the ground.

10. The method of claim 7 wherein said mounting device receives said elongated arm in a non-rotating relationship; and said support is secured to a base.

11. The method of claim 10 wherein said elongated arm is attached to said mounting device by a lock-position locator and said mounting device is secured to said base by a "U" shaped clamp.

12. The method of claim 10 wherein said mounting device is integral with said base.

13. The method of practicing the handling and impacting of an object which comprises the steps of a. providing an elongated arm that is substantially straight except for a curvature between an engagement end and a free end and a bend at said engagement end having a position locator;

b. inserting said position locator into a support so that said elongated arm extends horizontally from said support;

c. attaching an object at said free end of said elongated arm at an appropriate height for the practice of the impacting that is to be undertaken; and d. further including the step of rotationally adjusting a position of said arm with respect to said support by removing said arm, rotating it by a prescribed amount and returning it to said support.

14. The method of claim 13 further including the step of moving the position of said arm by lifting the end portion out of said support and moving it in 90° increments.

15. The method of claim 14 wherein a first movement of 90° moves said arm from a first position to a second position.

16. The method of claim 15 further including a further movement of 90° to move said arm to a third position.

17. The method of claim 16 wherein a still further movement of 90° moves said arm to a fourth position.

18. The method of claim 13 wherein said elongated arm is provided by two linear sections disposed at an obtuse angle greater than 145° relative to one another; and the end of said arm is secured to said support below the end position of said arm where said line is connected to said object.

19. The method of claim 13 wherein said elongated arm is provided by two linear sections joined together, with one linear section joined to said support having a length less than that of the other linear section.

20. The method as defined in claim 13 wherein said object is a ball.

* * * * *